US009543682B2

(12) United States Patent
Jin et al.

(10) Patent No.: US 9,543,682 B2
(45) Date of Patent: Jan. 10, 2017

(54) POKE-IN CONNECTOR

(71) Applicants: MOLEX INCORPORATED, Lisle, IL (US); Jang-Bum Jin, Lisle, IL (US); Ji-Soo Shin, Lisle, IL (US)

(72) Inventors: Jang-Bum Jin, Ansan (KR); Ji-Soo Shin, Ansan (KR)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/779,233

(22) PCT Filed: Mar. 31, 2014

(86) PCT No.: PCT/US2014/032373

§ 371 (c)(1),
(2) Date: Sep. 22, 2015

(87) PCT Pub. No.: WO2014/160998

PCT Pub. Date: Oct. 2, 2014

(65) Prior Publication Data

US 2016/0049745 A1 Feb. 18, 2016

(30) Foreign Application Priority Data

Mar. 29, 2013 (KR) ..... 10-2013-0034602

(51) Int. Cl.
*H01R 13/422* (2006.01)
*H01R 4/48* (2006.01)
(Continued)

(52) U.S. Cl.
CPC ..... *H01R 13/422* (2013.01); *H01R 4/4836* (2013.01); *H01R 12/515* (2013.01); *H01R 12/75* (2013.01)

(58) Field of Classification Search
CPC ..... H01R 12/53; H01R 12/422; H01R 13/423; H01R 13/426; H01R 13/4223; H01R 12/515; H01R 11/00; H01R 12/00
(Continued)

(56) References Cited

U.S. PATENT DOCUMENTS 5,525,071 A 6/1996 Obara et al.
5,597,332 A * 1/1997 Walbrecht ..... H01R 9/091 439/850

(Continued)

FOREIGN PATENT DOCUMENTS

JP 51-142181 U 11/1976
JP 54-41980 U 3/1979

(Continued)

*Primary Examiner* — Abdullah Riyami
*Assistant Examiner* — Harshad Patel
(74) *Attorney, Agent, or Firm* — James A. O'Malley

(57) ABSTRACT

The Present Disclosure relates to a poke-in connector configured so that a wire can be contacted at the same time it is locked to a terminal, solely by the action of pushing the wire into the terminal. More specifically, it relates to a poke-in connector that facilitates locking and unlocking of a wire. The poke-in connector of the Present Disclosure comprises a terminal where a wire is inserted and locked while making contact, and a housing that covers the terminal and is formed as one piece with a locking release lever that releases the wire from the locked state. The locking release lever comprises a flexible extension part that has elasticity and extends from the housing, and a pressing part that is formed on the terminus of the flexible extension part and enables the removal of the wire by spreading the locking part of the terminal to either side when pressed.

18 Claims, 8 Drawing Sheets

(51) Int. Cl.
*H01R 12/51* (2011.01)
*H01R 12/75* (2011.01)

(58) Field of Classification Search
USPC ..... 439/733.1, 725, 726, 746, 749, 296
See application file for complete search history.

(56) References Cited

U.S. PATENT DOCUMENTS

| | | | | |
|---|---|---|---|---|
| 7,513,793 | B2 | 4/2009 | Horst et al. | |
| 8,328,586 | B2 | 12/2012 | Bies et al. | |
| 8,882,533 | B2 * | 11/2014 | Brandberg | H01R 13/193 439/441 |
| 8,968,022 | B2 * | 3/2015 | Mostoller | H01R 4/4836 439/438 |
| 2011/0250775 | A1 * | 10/2011 | Bies | H01R 4/4836 439/296 |
| 2011/0250803 | A1 * | 10/2011 | Bies | H01R 4/4836 439/752.5 |
| 2013/0029529 | A1 * | 1/2013 | Osagie | H01R 4/4818 439/625 |

FOREIGN PATENT DOCUMENTS

| | | | |
|---|---|---|---|
| JP | 60-101883 | A | 6/1985 |
| JP | 06-36811 | A | 2/1994 |
| JP | 2000-243477 | A | 9/2000 |
| JP | 2003-317824 | A | 11/2003 |
| KR | 10-2008-0030174 | A | 4/2008 |

* cited by examiner

POKE-IN CONNECTOR

CROSS REFERENCE TO RELATED APPLICATIONS

The Present Disclosure claims priority to prior-filed Korean Patent Application No. 10-2013-0034602, entitled "Poke-in Connector," filed on 29 Mar. 2013 with the Korean Intellectual Property Office. The content of the aforementioned Patent Application is fully incorporated in its entirety herein.

BACKGROUND OF THE PRESENT DISCLOSURE

The Present Disclosure relates, generally, to a poke-in connector configured so that a wire can be contacted at the same time it is locked to a terminal, solely by the action of poking the wire into the terminal, and, more particularly, it relates to a poke-in connector that facilitates locking and unlocking of a wire.

Generally, conventional electrical devices contain connectors having a form such that the terminal that is connected to a wire is soldered to the surface of a printed circuit board (PCB), and is surrounded by an insulative housing. These connectors include "poke-in connectors," wherein the wire is locked to the terminal and contacted solely by the action of pushing the wire into the terminal. Examples of conventional poke-in connectors are disclosed in U.S. Pat. No. 7,513,793, entitled "Low Profile Surface Mount Poke-in Connector," and U.S. Pat. No. 8,328,586, entitled "Actuating Device for an Electrical Connection Terminal." The content of each of these Applications are hereby incorporated herein in their entireties.

With the connector disclosed in the '793 Patent, it is straightforward to push the wire into the terminal, but separating the wire from the terminal is somewhat difficult. Specifically, in order to detach the wire, a sharp tool must first be placed in the hole formed on the top of the housing, and then the terminal holding the wire must be pressed to release the clamping force, which is inconvenient. In addition, it is structurally difficult to press the terminal with the tool.

The connector disclosed in the '586 Patent has the advantage that the process of pushing the wire into the terminal and separating it from the terminal is more straightforward than in the '793 Patent. Specifically, the wire can easily be separated from the terminal by simply pressing the pusher arm formed on the insulator housing using a fingertip, screwdriver, etc. Despite this advantage, because the pusher arm is bent upward after extending to the side, the connector disclosed in the '586 Patent has considerable risk that the bent portion will suffer increased fatigue during repeated use. In addition, when the pusher arm is pressed, the degree to which the terminus of the arm is moved down is not consistent. Accordingly, if the pushing force is great, the wire can readily be separated from the terminal, while if the pushing force is slight, it is difficult for the wire to be separated from the terminal.

SUMMARY OF THE PRESENT DISCLOSURE

The object of the Present Disclosure, which has been devised in order to resolve the above-described problems, is to provide a poke-in connector that minimizes the fatigue of the lever that is pressed in order to release the lock, and that can keep the degree of separation of the wire consistent by maintaining a consistent lowered height when the lever is pressed.

The poke-in connector of the Present Disclosure comprises a terminal into which a wire is pushed and locked while making contact, and a housing that covers the terminal and formed as one piece with a locking release lever that releases the wire from the lock. The locking release lever comprises a flexible extension part that has elasticity and extends from the housing, and a pressing part formed on the terminus of the flexible extension part that enables the detachment of the wire by opening the locking parts of the terminal to either side when pressed. The housing consists of side surfaces and top surface.

The flexible extension part extends from the top surface. The flexible extension part is formed as a bending structure with elasticity. The flexible extension part comprises a first extension section that extends horizontally from the top surface of the housing. A bending section is bent downward from the terminus of the first extension section and then is bent upward. A second extension section extends horizontally from the terminus of the bending section.

On the top surface of the housing are respectively formed a terminal exposure hole that exposes the terminal from above and wherein the locking release lever is located. Lever stopper parts formed on the top of either side wall of the terminal exposure hole, having the shape of a groove, for restricting the degree to which the lever moves when pressed using a finger or tool.

On the upper inside of the housing, a guide part is formed that guides the wire inserted into the housing so that the wire can be inserted sloping diagonally downward. The guide surface of the guide part slants downward in the direction of insertion of the wire.

The terminal comprises a soldering part, in the form of a plate, soldered to the PCB. A pair of covering parts are respectively bent upward from either side of one terminus of the soldering part. A pair of locking parts extend from the respective covering part toward the other end of the soldering part, narrowing in width as they approach the terminus, so that the wire is locked when pushed in between the termini. Locking release parts face one another and extend from the top end of the respective locking parts. When releasing the lock, by inserting the bottom of the pressing part between them, the gap between the locking parts is widened so that the wire is released from the lock.

The locking release parts comprise vertical sections that extend vertically upward from the top of the locking part; horizontal sections that extend horizontally inward from the top of the vertical section, facing one another; and a tilting section that extends downward from the terminus of the horizontal section and tilts outward as it moves downward. Both sides of the pressing part of the locking release lever catch on the bent part between the horizontal section and the tilting section, thus limiting insertion. At the terminus of each locking part, the clamping force on the pushed-in wire is increased by the wire being surrounded on either side, and grooves of rounded form are extended that expand the contact area.

The locking parts comprise first extension sections that are respectively extended from the covering part toward the opposite end of the soldering part, opposite one another; second extension sections that respectively extend from the first extension sections toward the opposite end of the soldering part, and extend parallel to one another; and third extension sections that respectively extend from the second extension sections toward the opposite end of the soldering part, and bend toward one another, the wire being pushed in between their termini. To reinforce the strength of the bent section formed between the covering part and first extension section, respective beads are formed on the bent section, protruding inward. On either side of the soldering part, wedge-shaped wedge coupling parts are each extended upward to strengthen the coupling between terminal and housing, and catch lips are formed on the exterior of each covering part, protruding outward, to catch on the inside of the side surface of the housing. When the wire is completely pushed in, the soldering part and the terminus of the wire are spaced apart from one another, and the soldering part is formed in the shape of a panel.

The poke in connector of the Present Disclosure has, at least, the following effects. First, the locking release lever, designed to be pressed to release the locking, is extended from the top surface of the housing, and the extension part that forms the locking release lever is formed as a bending structure, thus increasing elasticity and thereby enabling the fatigue of the locking release lever to be minimized, and a more straightforward operation of the locking release lever.

Second, by forming the lever stopper part in the form of a groove on the top of the wall of either side of the terminal exposure hole formed in the housing, in order to limit the distance that the locking release lever is pressed, the locking release status of the wire can be held constant due to the locking release lever always being pressed by a specified distance when releasing the wire from the locked state by pressing the locking release lever using a finger or tool. Specifically, in conventional connectors, because the press distance of the element that is pressed to release the lock varies depending on the force applied, there is the problem that the wire may be well-fastened at one time and not well-fastened at another. In the Present Disclosure, in contrast, the wire is always well-fastened because the press distance is always fixed.

Third, a guide part is formed that guides the insertion of the wire into the upper inside of the housing. By forming the guide surface of the guide part tilting downward in the direction of wire insertion, the wire can be inserted automatically at an angle by simply inserting the wire into the housing and pushing it. Thus, the insertion of the wire is straightforward.

Fourth, a wedge-shaped wedge coupling part is formed on the soldering part that couples to the housing. By forming the catch lip on the covering part that catches on the inside of the housing, the housing is coupled firmly to the terminal. Therefore, even when the wire is moved, there is no risk that the housing will be separated from the terminal.

Fifth, by forming a rounded insertion groove at the terminus of the locking parts to which the wire is locked, to surround the wire, the clamping force on the wire is increased so that the lock is kept firm, and the contact area between wire and terminal is expanded. And finally, by forming beads that protrude into the interior in the bending section formed between the covering part and locking part, the strength of the bending section is reinforced.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Figure 1:
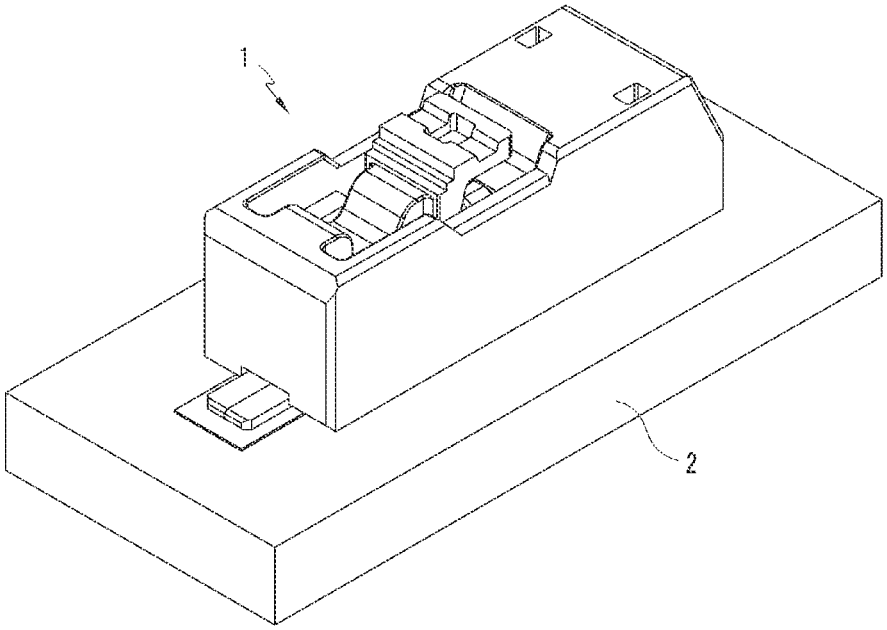
FIG. 1 is an oblique view showing the poke-in connector according to an embodiment of the Present Disclosure in its installed state.
Figure 2:
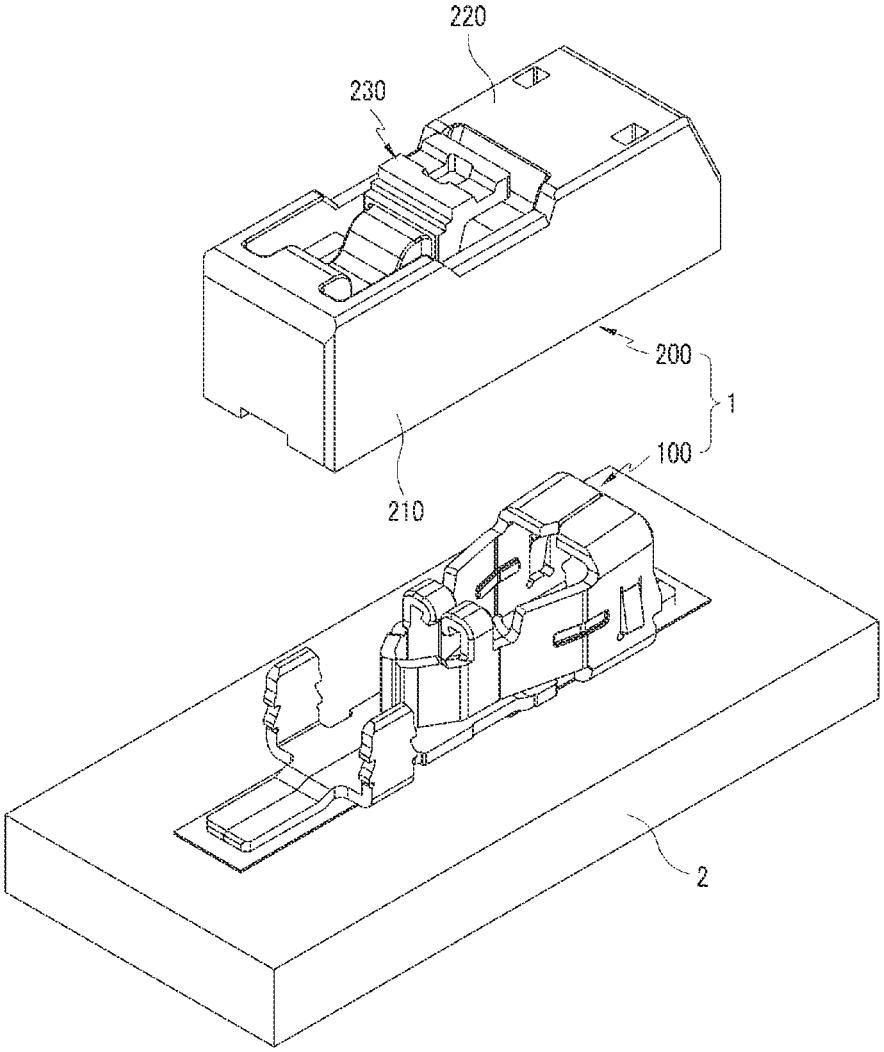
FIG. 2 is an exploded view of FIG. 1.
Figure 3:
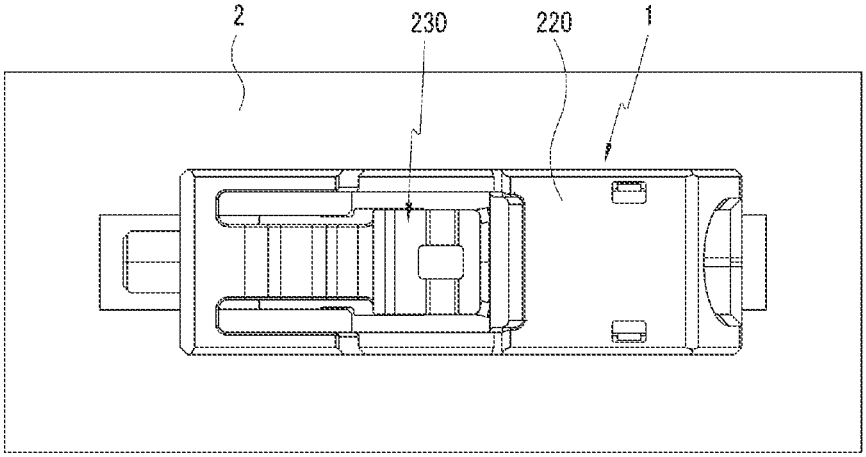
FIG. 3 shows FIG. 1 from above.
Figure 4:
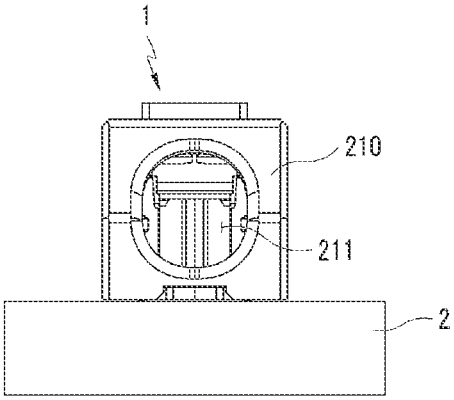
FIG. 4 shows FIG. 1 from the side.

Referring to the Figures, and, in particular, FIGS. 1-3, the poke-in connector 1 according to this embodiment comprises a terminal 100 mounted on a PCB 2, wherein a wire is pushed in to be locked and connected, and a housing 200 that protects the terminal 100 by covering it. The housing 200 comprises side surfaces 210 and a top surface 220. On the top surface 220 of the housing 200, a locking release lever 230 is formed as a single unit, an that the wire can be released from the locked state, and on one of the side surfaces 210 of the housing 200 is formed a wire insertion hole 211 into which the wire is inserted. According to the poke-in connector 1 of the Present Disclosure having this structure, if the wire is simply inserted via the wire insertion hole 211, upon being pushed into the terminal 100 the wire is locked in and connected to the terminal 100. Simply by pressing the locking release lever 230, the lock is released, so that the wire 3 can readily be separated from the terminal 100.

Figure 5:
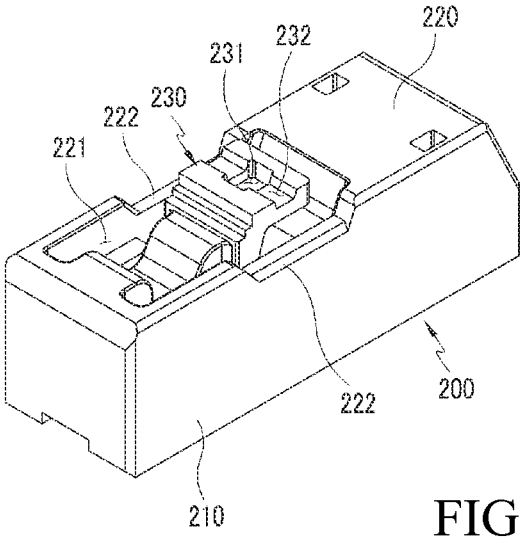
FIG. 5 is an oblique view of the housing used in the poke-in connector of FIG. 1.
Figure 6:
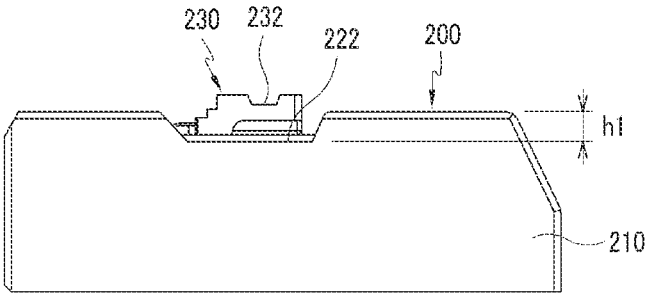
FIG. 6 is a head-on view of the housing of FIG. 5.

Referring generally to FIGS. 5-6, on the terminus of the locking release lever 230 is formed a pressing groove to enable pressing by a finger or tool. The pressing groove comprises a first pressing groove 231 formed on the top center part of the locking release lever 230 terminus, that can be pressed using a tool such as a gimlet or screwdriver; and a second pressing groove 232 formed along the width direction of the locking release lever 230 terminus, intersecting the first pressing groove 231, that can be pressed using a finger, screwdriver, etc.

On the top surface of the housing 200 is formed a terminal exposure hole 221 to expose the terminal from above, A locking release lever 230 is formed within the terminal exposure hole 221. On the top part of either side wall of the terminal exposure hole 221 are formed respective lever stopper parts 222 in the form of grooves that prevent the insertion of the terminus of the locking release lever 230 into the terminal exposure hole 221 more than necessary, by causing the finger or toot to catch when the terminus of the locking release lever 230 is pressed using a finger or tool. Consequently, because the height hi by which the terminus of the locking release lever 230 is lowered when releasing the wire from the lock is constant, the manner of release of the lock can be uniform whenever the wire is released from the locked state. Thus, there is no problem of the wire sometimes coming out easily and sometimes not coming out easily when removing the wire upon unlocking; it will always come out easily.

Figure 7:
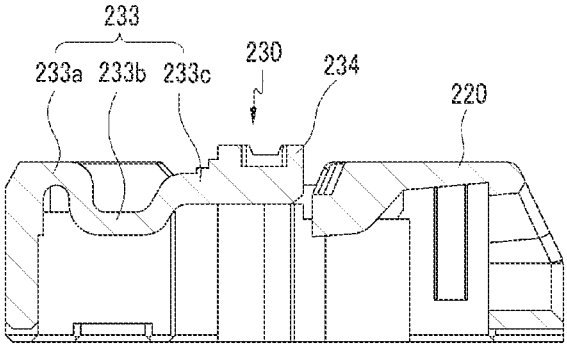
FIG. 7 is a cross-section of the housing of FIG. 5.

Referring, generally, to FIG. 7, the locking lever 230 comprises: a flexible extension part 233 that extends from the housing 200 and has a bending structure to enhance elasticity. A pressing part 234 is formed at the terminus of the flexible extension part 233 and causes the wire to be released from the locked state by spreading the locking sections of the terminal 100 to either side when it is pressed.

The flexible extension part 233 extends from the top surface 220 of the housing 200 and is located within the terminal exposure hole 221. This flexible extension part 233 comprises a first extension section 233*a* that extends horizontally from the top surface 220 of the housing 200, a bending section 233*b* that first bends vertically downward from the terminus of the first extension section 233*a* and then extends horizontally and ultimately is bent to tilt upward, and a second extension section 233*c* that extends horizontally from the terminus of the bending section 233*b*. The locking release lever 230 has greater elasticity than the pusher shown in the '586 Patent due to this flexible extension part 233.

Table 1, below, presents, for reference, a comparison of the force exerted to press the locking release lever 230 of the Present Disclosure and the pusher 21 disclosed in the '586 Patents, made from the same material, by the same height (0.7 mm).

| | Force Acting on the Lever/Pusher |
|---|---|
| Present Disclosure | 3.66N |
| Disclosure of the '586 Patent | 4.75N |

In the case of the locking release lever 230 of the Present Disclosure, 3.66 N is needed to move it by 0.7 mm. In the case of the pusher 21 disclosed in the '586 Patent, 4.75 N is needed to move it by 0.7 mm. This is because of the difference in elasticity between the locking release lever 230 and the pusher 21. Specifically, it is because the elasticity of the locking release lever 230 of the Present Disclosure is superior to the elasticity of the pusher 21 disclosed in the '586 Patent.

This difference in elasticity has a substantial influence not only when the locking release lever 230 and pusher 21 are pressed to release the wire from the lock, but also on their recovery to their initial state when the lock is released. Specifically, the recovery of the locking release lever 230, having high elasticity, occurs faster than the pusher 21 disclosed in the '586 Patent.

The difference in elasticities thus leads to a difference in fatigue. In the case of the Present Disclosure, the elasticity is increased by forming the flexible extension part 233 that makes up the locking release lever 230 as a bending structure, so that the fatigue on the locking release lever 230 can be minimized.

Figure 8:
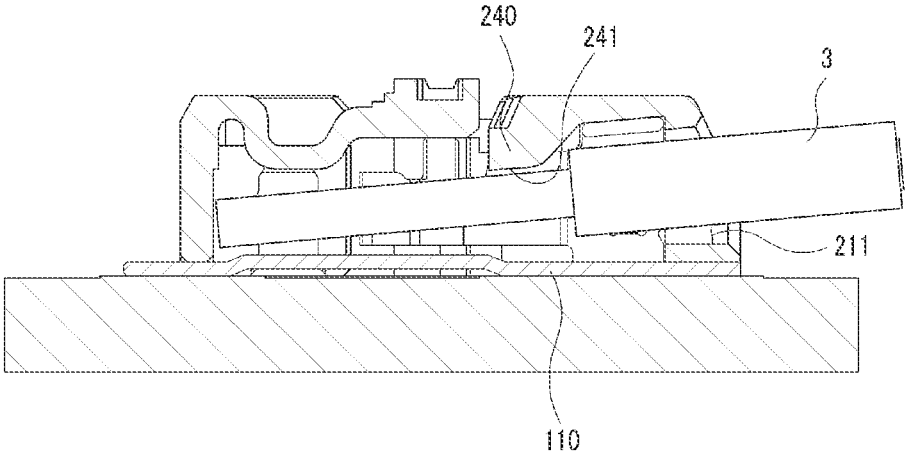
FIG. 8 is a cross-section of the poke-in connector of FIG. 1, showing the wire pushed in, with the housing and terminal coupled.
Figure 9:
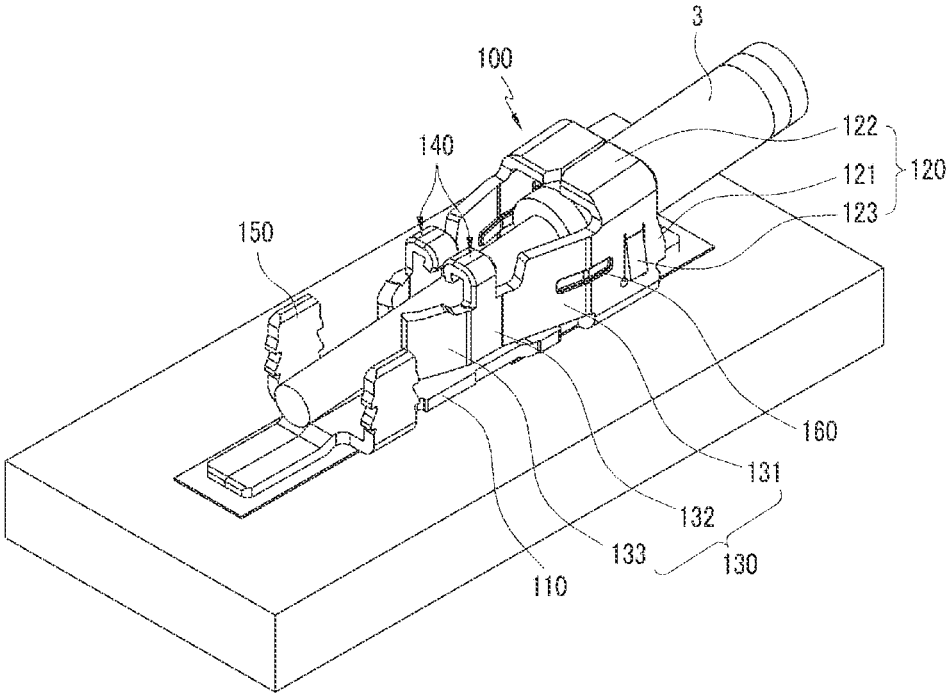
FIG. 9 is an oblique view of the wire pushed into the terminal.

Referring, generally, to FIGS. 8-9, on the inner top of the housing 200 is formed a guide part 240 that guides the wire 3 inserted into the housing 200 so that it can be inserted tilting downward and diagonally. The guide surface 241 of the guide part 240 is formed sloping downward in the direction of insertion of the wire 3. Therefore, the wire 3 is automatically inserted at a slant simply by inserting the wire 3 through the wire insertion hole 211.

The terminal 100 comprises a soldering part 110, a pair of covering parts 120, a pair of locking parts 130 and a pair of locking release parts 140. The soldering part 110 is the part that is soldered to the PCB, and is formed in an overall flat panel shape. When the wire 3 is inserted, the soldering part 110 and the terminus of the wire 3 are spaced apart from one another. Therefore, because when the wire 3 is removed by pulling it upward, the terminus of the wire 3 does not contact the soldering part 110, the wire 3 can be straightforwardly removed. At either side of the other terminus of the soldering part 110, respective wedge coupling parts 150 in wedge shape are extended so as to firmly couple with the sides of the housing 200.

The covering parts 120 are respectively bent upward from either side of one terminus of the soldering part 110 to surround the wire 3. These covering parts 120 comprise a vertical extension section 121 that extends vertically upward from the soldering part 110, and a horizontal extension section 122 that extends horizontally inward from the vertical extension section 121, each facing the other. On the outside of the vertical extension part 121 of each covering part 120, catch lips 123 are formed protruding outward, so that the inside of the side surface of the housing 200 will catch on them, thus ensuring a firm coupling with the side surface of the housing 200.

The locking parts 130 respectively extend from each covering part 120 toward the opposite end of the soldering part 110. They narrow toward the terminus, and lock when the wire 3 is pushed in between the termini. These locking parts 130 comprise first extension sections 131 that extend from the respective covering part 120 toward the far end of the soldering part 110 and are tilted toward one another, second extension sections 132 that are extended from the first extension sections 131 to the far end of the soldering part 110 and extend in parallel to one another, and third extension sections 133 that are respectively extended from the second extension sections 132 toward the far end of the soldering part 110 and are extended while tilting toward one another, locking the wire 3 between the termini when it is pushed in.

The locking release parts 140 are extended opposite to one another from the top of the respective locking part 130. Upon locking release, they ensure that the wire 3 is released from the locked state by causing the locking parts 130 to spread apart when the wire 3 is inserted between the lower ends of the pressing part 234. On the bent sections formed across the covering part 120 and first extension section 131 are formed respective beads 160 protruding inward to reinforce the strength of the bent sections.

Figure 10:
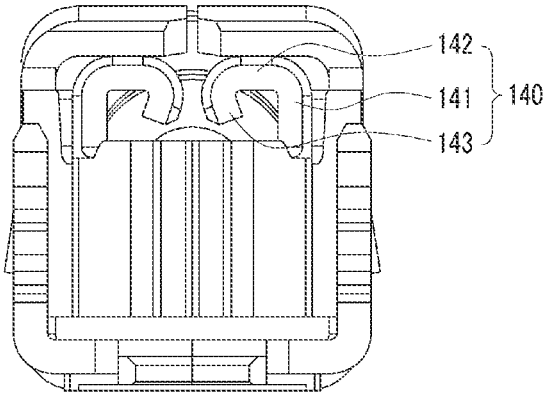
FIG. 10 is a head-on view of the terminal.
Figure 11A:
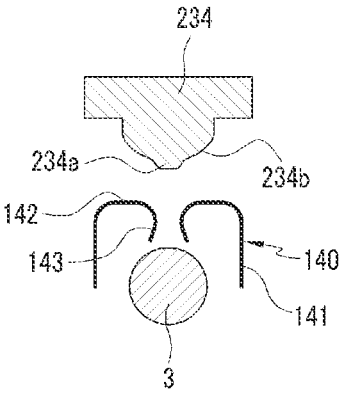
FIGS. 11A-11C show the lock of the wire being released by pressing down on the pressing part of the locking release lever.
Figure 11B:
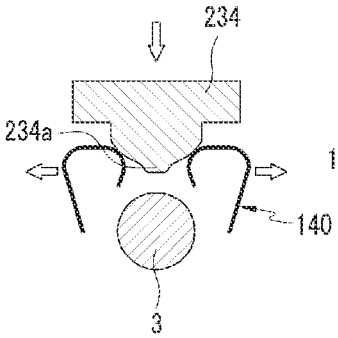
Figure 11C:
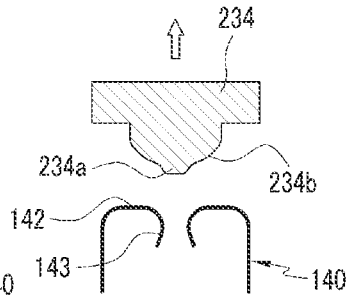

Referring, generally to FIGS. 10-11C, the locking release lever 140 comprises vertical sections 141 that extend vertically upward from the top of the respective locking part 130, horizontal sections 142 that extend horizontally inward toward one another from the top of the vertical section 141, and tilted sections 143 that extend downward from the terminus of the horizontal sections 142 and tilt outward. ON the bottom of the pressing part 234 of the locking release lever 230 is formed a push-in section 234*a* that causes the locking parts 130 to spread open as the pressing part 234 is pressed downward and pushed between the pair of locking parts 130. On either side of the push-in section 234*a* is formed a respective catch lip 234*b* that restricts the push-in section 234*a* from being inserted any further by catching on the bent part between the horizontal section 142 and the tilted section 143 when the pressing part 234 is pressed.

Reviewing the process of releasing the lock on the wire 3, if as shown in FIG. 11A, the pressing part 234 of the locking release lever 230 is pressed, then as shown in FIG. 11B, the push-in section 234*a* of the pressing part 234 is pushed in between the locking parts 130 while the two locking parts 130 are spread apart so as to release the lock on the wire 3. If the wire 3 is removed upon the release of the lock on the wire 3, and the force that had been pressing the pressing part 234 is also released, the pressing part 234 will return to its original state due to the elasticity of the flexible extension part 233.

In this process, because the area of contact between the push-in section 234*a* and the tilted section 143 (i.e., the area of the rounded section between the horizontal section 142 and the tilted section 143) is small, the pressing part 234 can readily be returned to its original state. In particular, because the terminus of the tilted section 143 does not contact the push-in section 234*a* due to the lower part of the tilted section 143 tilting outward, the push-in section 234*a* has no effect at all on the terminus of the tilted section 143 during operation.

Figure 12:
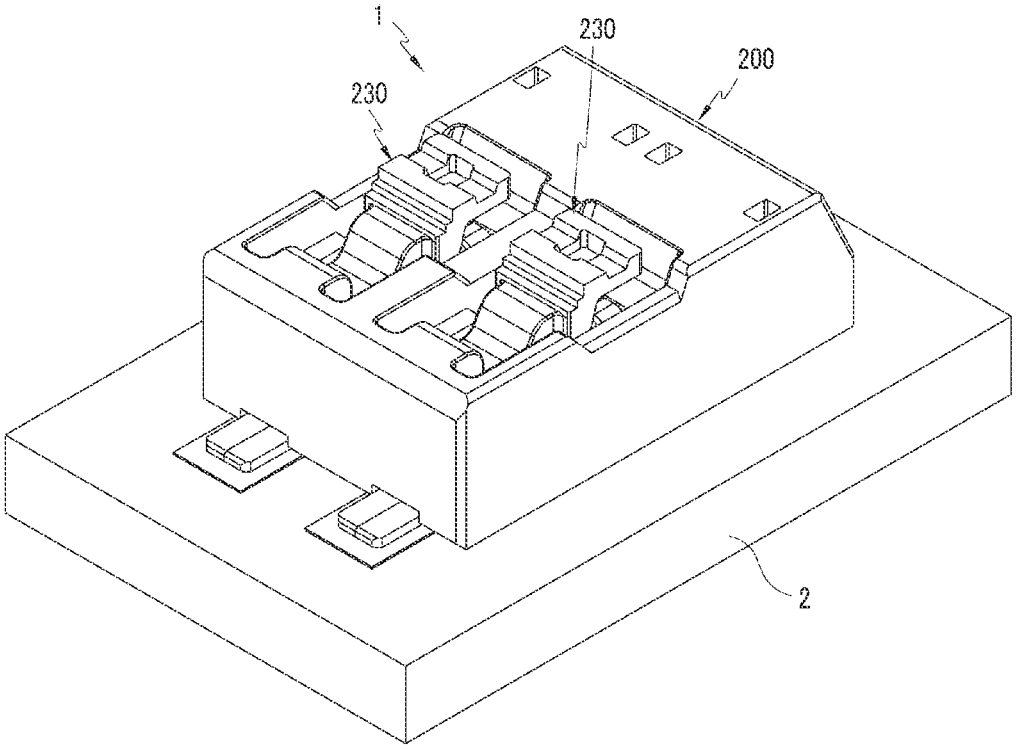
FIG. 12 is an oblique view showing the poke-in connector according to another embodiment of the Present Disclosure in its installed state.

FIG. 12 generally discloses another embodiment of the Present Disclosure. According to the poke-in connector 1 of this embodiment, two terminals (not shown) are soldered to a PCB and are covered by a single housing 200, thus enabling two wires to be connected to a single connector 1. Two locking release levers 230 are furnished on the single housing 200 to enable the respective lock of one of the two wires to be released.

The configuration of the terminals, and of the locking release levers, are identical to the first embodiment, and the description thereof is accordingly omitted.

Figure 13:
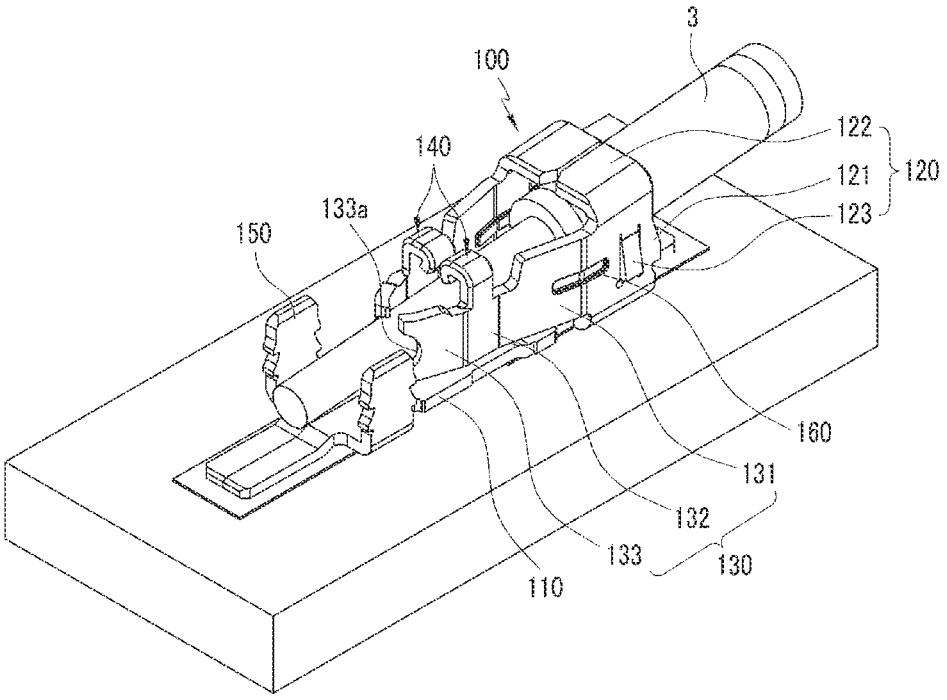
FIG. 13 is an oblique view showing the wire pushed into the terminal of the poke-in connector according to another embodiment of the Present Disclosure.

FIG. 13 generally discloses another embodiment of the Present Disclosure. According to this embodiment, on the terminus of the third extension section 133 in the locking part 130 is formed a rounded push-in groove 133*a* that entirely surrounds either side of the wire 3. Therefore, the contact area between the wire 3 and the third extension section 133 is expanded, and the wire 3 is reliably clamped and locked in place.

Figure 14:
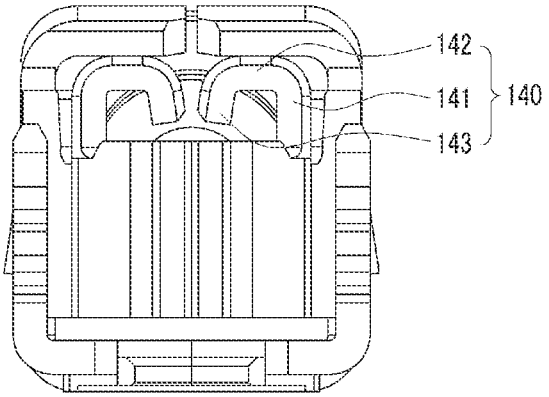
FIG. 14 is a head-on view showing the terminal of the poke-in connector according to another embodiment of the Present Disclosure.

FIG. 14 generally discloses another embodiment of the Present Disclosure. Although the pair of tilted sections 143 can be formed tilting outward as in the first embodiment, the configuration is not limited thereto. As in this embodiment, the pair of tilted sections 143 can be formed tilting inward toward one another. In this case, the bottom corner of the tilted section 143 is subjected to rounding treatment, thus enabling the push-in section 234*a* formed in the pressing part 234 of the locking release lever 230 to readily be detached from between the tilted sections 143 after the wire has been released from the locked state.

While a preferred embodiment of the Present Disclosure is shown and described, it is envisioned that those skilled in the art may devise various modifications without departing from the spirit and scope of the foregoing Description and the appended Claims.

What is claimed is:

1. A poke-in connector, the poke-in connector comprising:

a terminal which is configured to have a wire pushed therein and locked into position; and a housing, the housing covering the terminal and formed as one piece, the housing having a side surface, a top surface, and a locking release lever that releases the wire when it is locked in position in the terminal, the locking release lever includes a flexible extension part and a pressing part, the flexible extension part having elasticity, the flexible extension part includes first and second extension sections and a bending section, the first extension section extending inwardly and horizontally from the top surface of the housing, the bending section extending inwardly from the first extension section to the second extension section, the bending section first bending downwardly from the first extension section and then bending upwardly to the second extension section, the second extension section extending inwardly and horizontally from the bending section, the pressing part extending inwardly from the second extension section and being configured to enable the detachment of the wire by being configured to unlock the terminal when pressed.

2. The poke-in connector of claim 1, wherein the flexible extension part is formed as a bending structure.

3. The poke-in connector of claim 1, wherein a terminal exposure hole is formed on the top surface of the housing, the terminal exposure hole exposing the terminal from above, the locking release lever being located above the terminal.

4. The poke-in connector of claim 3, wherein level stopper parts are provided on a top of either side wall of the terminal exposure hole, the stopper parts taking the form of grooves to limit the degree to which the locking release lever can be pressed.

5. The poke-in connector of claim 1, wherein a guide part is provided on an upper inside of the housing, the guide part configured to guide the wire inserted into the terminal so that the wire can be inserted sloping downward diagonally.

6. The poke-in connector of claim 5, wherein the guide part has a guide surface which slopes downward in a direction of insertion of the wire.

7. The poke-in connector of claim 1, wherein the terminal further includes: a panel-shaped soldering part, the panel-shaped soldering part having first and second opposite ends and being configured to be soldered to a PCB; a pair of covering parts, each covering part being bent upward from either side of the soldering part proximate to the first end thereof in order to surround the wire; a pair of locking parts, each locking part extending from the respective covering part toward the second end of the soldering part, the locking parts defining a gap therebetween which gap narrows in width as the locking parts extend from proximate the first end of the soldering part toward the second end of the soldering part such that the wire is configured to be locked when pushed in between the locking parts; and locking release parts, each locking release part extending from a top end of the respective locking part, wherein when a bottom part of the pressing part is inserted between the locking release parts, the gap between the locking parts is widened so that the wire can be released from the locked state.

8. The poke-in connector of claim 7, wherein, on the terminus of each locking part is formed an insertion groove, the insertion groove having a rounded shape, the insertion groove increasing the clamping force on the wire and expands the contact area by surrounding each side of the wire that is pushed in.

9. The poke-in connector of claim 8, wherein the locking parts include: first extension sections, each first extension section extending from the covering part toward the second end of the soldering part, opposite another first extension section; second extension sections, each second extension section extending from the first extension sections toward the second end of the soldering part, parallel to another second extension section; and third extension sections, each third extension section extending from the second extension sections toward the second end of the soldering part, and tilting and extending to face another third extension section, the wire being pushed in between their termini.

10. The poke-in connector of claim 9, wherein each locking part has a bent section provided between the covering part and the first extension section, and wherein, in order to reinforce the strength of the bent section, a bead is formed protruding toward the inside on the bent section.

11. The poke-in connector of claim 7, wherein the locking parts include: first extension sections, each first extension section extending from the covering part toward the second end of the soldering part, opposite another first extension section; second extension sections, each second extension section extending from the first extension sections toward the second end of the soldering part, parallel to another second extension section; and third extension sections, each third extension section extending from the second extension sections toward the second end of the soldering part, and tilting and extending to face another third extension section, the wire being pushed in between their termini.

12. The poke-in connector of claim 11, wherein each locking part has a bent section provided between the covering part and the first extension section, and wherein, in order to reinforce the strength of the bent section, a bead is formed protruding toward the inside on the bent section.

13. The poke-in connector of claim 7, wherein each locking release part includes a vertical section, a horizontal section, and a tilted section, each vertical section extending vertically upward from the top of the locking part, each horizontal section extending horizontally inward toward one another from the top of the vertical section, each tilted section extending downward from the termini of the horizontal sections and tilting outward as they descend.

14. The poke-in connector of claim 13, wherein each locking release part has a bent part provided between the horizontal section and the tilted section, and wherein a side of the pressing part of the locking release lever catches on the bent part of the locking release parts to limit the degree of insertion.

15. The poke-in connector of claim 1, wherein, on either side of the soldering part, wedge-shaped wedge coupling parts extend upward to strengthen the coupling between terminal and housing, and catch lips are formed on an exterior of each covering part, protruding outward, so that an inside of the side surface of the housing will catch on the catch lips.

16. The poke-in connector of claim 1, wherein, when the wire is fully pushed in, the terminus of the wire and the soldering part are spaced apart from one another, and the soldering part is formed entirely in the shape of a panel.

17. A poke-in connector, the poke-in connector comprising:

a terminal which is configured to have a wire pushed therein and locked into position, the terminal including a panel-shaped soldering part, a pair of covering parts, a pair of locking parts, and locking release parts, the panel-shaped soldering part having first and second opposite ends and being configured to be soldered to a PCB, each covering part being bent upward from either side of the soldering part proximate to the first end thereof in order to surround the wire, each locking part extending from the respective covering part toward the second end of the soldering part, the locking parts defining a gap therebetween which gap narrows in width as the locking parts extend from proximate the first end of the soldering part toward the second end of the soldering part such that the wire is configured to be locked when pushed in between the locking parts, each locking release part extending from a top end of the respective locking part, wherein each locking release part includes a vertical section, a horizontal section, and a tilted section, each vertical section extending vertically upward from the top of the locking part, each horizontal section extending horizontally inward toward one another from the top of the vertical section, each tilted section extending downward from the termini of the horizontal sections and tilting outward as they descend; and a housing, the housing covering the terminal and formed as one piece, the housing having a locking release lever that releases the wire when it is locked in position in the terminal, the locking release lever includes a flexible extension part and a pressing part, the flexible extension part having elasticity and extending from the housing, the pressing part formed on a terminus of the flexible extension part and being configured to enable the detachment of the wire by being configured to unlock the terminal when pressed, wherein when a bottom part of the pressing part is inserted between the locking release parts, the gap between the locking parts is widened so that the wire can be released from the locked state.

18. The poke-in connector of claim 17, wherein each locking release part has a bent part provided between the horizontal section and the tilted section, and wherein a side of the pressing part of the locking release lever catches on the bent part of the locking release parts to limit the degree of insertion.

* * * * *